US006271714B1

(12) United States Patent
Shin

(10) Patent No.: US 6,271,714 B1
(45) Date of Patent: Aug. 7, 2001

(54) SUBSTRATE VOLTAGE GENERATOR FOR SEMICONDUCTOR DEVICE

(75) Inventor: Youn Cherl Shin, Bucheon (KR)

(73) Assignee: Hyundai Electronics Industries Co., Ltd., Kyoungki-Do (KR)

( * ) Notice: Subject to any disclaimer, the term of this patent is extended or adjusted under 35 U.S.C. 154(b) by 0 days.

(21) Appl. No.: 09/192,275

(22) Filed: Nov. 16, 1998

(30) Foreign Application Priority Data

Apr. 13, 1998 (KR) ..... 98-13084

(51) Int. Cl.[7] ..... G05F 1/46
(52) U.S. Cl. ..... 327/535; 327/143
(58) Field of Search ..... 327/142, 143, 327/198, 534, 535, 537, 536

(56) References Cited

U.S. PATENT DOCUMENTS 5,003,197 * 3/1991 Nojima et al. ..... 327/536
5,367,489 * 11/1994 Park et al. ..... 327/534
5,399,928 * 3/1995 Lin et al. ..... 327/434
5,408,140 * 4/1995 Kawai et al. ..... 327/536
5,506,540 4/1996 Sakurai et al. ..... 327/535
5,602,506 * 2/1997 Kim et al. ..... 327/535
5,767,729 * 6/1998 Song ..... 327/536
5,907,257 * 5/1999 Liu et al. ..... 327/143
5,945,870 * 8/1999 Chu et al. ..... 327/536
5,952,872 * 9/1999 Hur ..... 327/535

* cited by examiner

*Primary Examiner*—Timothy P. Callahan
*Assistant Examiner*—Terry L. Englund

(57) ABSTRACT

A substrate voltage generator for a semiconductor device that prevents a substrate voltage from being generated at an abnormal level which is too low or high. Control of an oscillator and a pumping circuit which is operated according to an output supplied from the oscillator is performed, and a substrate voltage value is monitored during a plurality of time periods until the substrate voltage reaches the desired level for each time period. Each time period is set by one of a plurality of delay units during a power-up interval. When substrate voltage at an extreme level is detected within a particular time period, a control signal for activating the oscillator is no longer supplied until the next time period.

10 Claims, 5 Drawing Sheets

FIG. 1
CONVENTIONAL ART
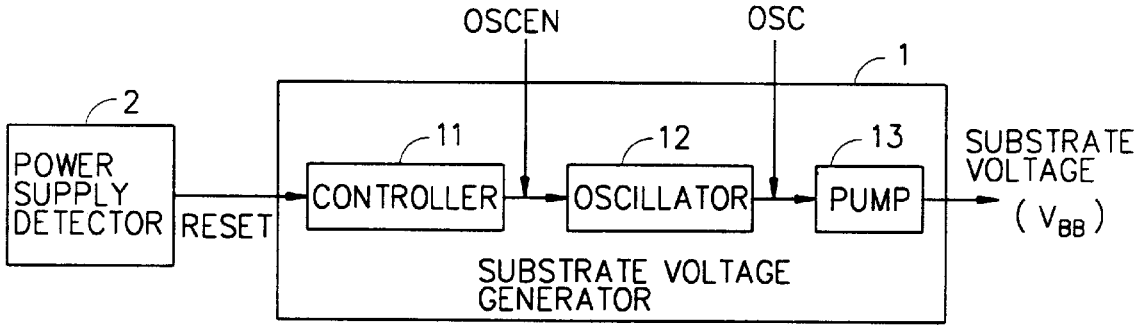
FIG.2A
CONVENTIONAL ART
FIG.2B
CONVENTIONAL ART
FIG.2C
CONVENTIONAL ART
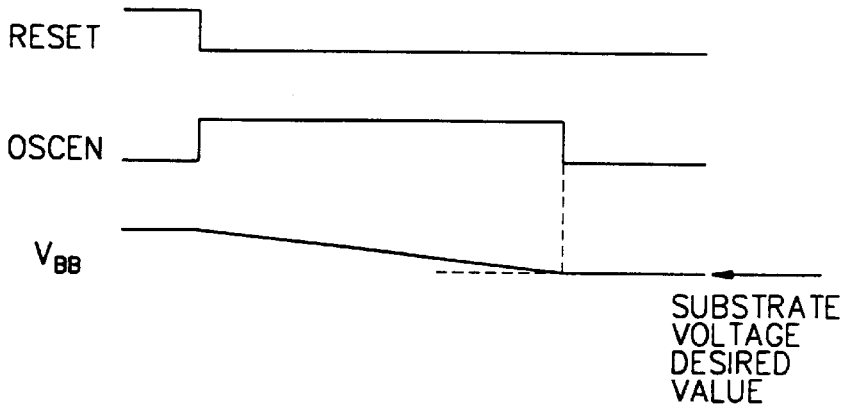

t1
t2
t3
tN
FIG.6A RESET
FIG.6B AA
FIG.6C OUT_A
FIG.6D A1
FIG.6E A2
FIG.6F BB
FIG.6G OUT_B
FIG.6H B2
FIG.6I N2
FIG.6J PWROKB
FIG.6K OSCEN 2
FIG.6L OSCEN 1
POWER-UP END

TIME [t]
VBB DESIRED VALUE AFTER t2
I
II
VBB
VBB DESIRED VALUE AFTER t3
VBB DESIRED VALUE
SUBSTRATE VOLTAGE [V]

SUBSTRATE VOLTAGE GENERATOR FOR SEMICONDUCTOR DEVICE

BACKGROUND OF THE INVENTION

1. Field of the Invention

The present invention relates to a semiconductor, and more particularly to a substrate voltage generator for a semiconductor which prevents a substrate voltage from being generated at an abnormally extreme level.

2. Discussion of the Background

In a semiconductor device receiving initial power-up voltage, a substrate voltage generator is required to supply a stable substrate voltage up to a predetermined level.

FIG. 1 schematically illustrates a typical substrate voltage generator. As shown therein, a conventional substrate voltage generator 1 supplies a desired substrate voltage $V_{BB}$ with the start of power-up detection.

The substrate voltage generator 1, connected with a power supply detector 2, receives a detection signal at a predetermined level supplied from the power supply detector 2 in accordance with the power-up. The substrate voltage generator 1 is composed of a controller 11, an oscillator 12 and a pump circuit 13. The substrate voltage $V_{BB}$ is outputted from the pump circuit 13 as a final output.

With reference to FIGS. 2A through 2C, an operation of the substrate voltage generator 1 will be described.

First, the start of power-up is informed by which a level of an externally applied power supply voltage Vcc is detected by the power supply detector 2, and the power supply detector 2 at a high level is transited to a low level, as shown in FIG. 2A, and informs the transit point by a reset signal. The power supply voltage Vcc is gradually increased up to a predetermined level in accordance with the power-up, and the power supply detector 2 detects the predetermined level and thus generates the reset signal.

The thusly generated reset signal is applied to the controller 11 of the substrate voltage generator 1. The controller 11 supplies an oscillator enable signal OSCEN, which was transited to a high level at the point where the reset signal was generated, as shown in 2B, to the oscillator 12. The controller 11 which controls the operation of the oscillator 12 to obtain the desired substrate voltage $V_{BB}$ level is constructed to sense the level of the substrate voltage $V_{BB}$.

The oscillator 12 corresponds to the signal supplied from the controller 11 and generates an oscillation signal OSC which has a predetermined cycle. The oscillation signal OSC from the oscillator 12 is supplied to the pump circuit 13 which will generate the substrate voltage $V_{BB}$, as shown in FIG. 2C. Since the initial level of the substrate voltage $V_{BB}$ is considerably different from the desired value, the substrate voltage generator 1 operates so that the substrate voltage $V_{BB}$ is sensed by the controller 11, for thus obtaining the desirable voltage level.

When the substrate voltage $V_{BB}$ level reaches the desired value, the oscillator enable signal OSCEN supplied from the controller 11 is outputted at a low level, as shown in FIG. 2B, for thereby completing the operation of the substrate voltage generator 1.

In the conventional art, however, when the level of the externally applied power supply voltage Vcc is high, or a substrate voltage loading is small, for example when the substrate voltage $V_{BB}$ is pumped at an extreme level because the driving capability of pumping for generating the substrate voltage $V_{BB}$ is great, the substrate voltage $V_{BB}$ level may not be controlled. In such a case, as shown in FIG. 2C, the final level of the substrate voltage $V_{BB}$ may be reached faster than the designed arrival time allated for the substrate voltage to reach the desired level. This unwanted situation may cause erroneous operations in other voltage generators of the chip device, and particularly become the cause of reference voltage generators being faulty. In other words, an erroneous operation of the substrate voltage generator in the initial power-up for the semiconductor device may change the reference voltage, due to the substrate voltage level being too low or too high.

Similarly, when a precharge voltage $V_{BLP}$ with respect to bit lines or a cell plate voltage $V_{CP}$ in a semiconductor memory device has an abnormally high or low level, the substrate voltage varies due to an erroneous operation related to other factors which are operated with the relation to the voltage level, and thus the entire semiconductor device may have operational problems.

SUMMARY OF THE INVENTION

Accordingly, an object of the present invention is to provide a substrate voltage generator which is stably operated in a semiconductor device.

Another object of the present invention is to provide a substrate voltage generator for a semiconductor device that prevents a substrate voltage from changing at too great a rate in initial power-up of the semiconductor device.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, in a substrate voltage generator of a semiconductor device for supplying power to a semiconductor substrate up to a predetermined level during power-up, the substrate voltage generator for a semiconductor device includes: a control unit for controlling an operation of the semiconductor voltage generator in accordance with a generated substrate voltage level when power is applied; an oscillator operated by the control unit; a pump circuit for performing a pumping operation in accordance with the oscillator, for thereby generating a substrate voltage; and an extreme operation preventing unit for preventing the substrate voltage from being generated at an extreme level by controlling the operation of the oscillator in accordance with the generated substrate voltage level at each of a plurality of periods, until the substrate voltage reaches a predetermined desired value.

In the above construction, in order to achieve the objects of the present invention, the extreme operation preventing means is provided with a plurality of delay means and a plurality of substrate voltage sensing means, each being separately operated during each of a plurality of time periods.

It is to be understood that both the foregoing general description and the following detailed description are exemplary and explanatory and are intended to provide and further explanation of the invention as claimed.

BRIEF DESCRIPTION OF THE DRAWINGS

The accompanying drawings, which are included to provide a further understanding of the invention and are incorporated in and constitute a part of this specification, illustrate an embodiment of the invention and together with the description serve to explain the principles of the invention.

In the drawings:

FIG. 1 is a schematic block diagram of a conventional substrate voltage generator of a semiconductor device;

FIGS. 2A to 2C are waveform diagrams illustrating a waveform of each unit in FIG. 1;

FIGS. 6A to 6M are waveform diagrams of each unit in FIGS. 3 and 4 in order to explain an operation of the substrate voltage generator for the semiconductor device according to the present invention.

DETAILED DESCRIPTION OF THE INVENTION

Reference will now be made in detail to the preferred embodiment of the present invention, examples of which are illustrated in the accompanying drawings.

In the specification of the invention, the term 'extreme' indicates, unless other particular explanations are mentioned, a state of the voltage level which is lower or higher than a desired voltage level and thus affects operations of other factors. Further, an example applied in connection with an extreme operation preventing method is mainly related with a substrate voltage generator which is used in the initial power-up of a semiconductor device, but note that the same can be also applied to a bit line precharge voltage generator or a cell plate voltage generator which employs a voltage having a half level of a power supply voltage. Now, the present invention will be described with respect to a substrate voltage generator.

The substrate voltage generator according to the present invention adopts an extreme operation preventing means. Accordingly, a substrate voltage generation process which commences in accordance with the initial power-up is entirely under the control of the above means. Particularly, an output of a control unit which makes the substrate voltage reach a desired level is controlled by the extreme operation preventing means.

Figure 3:
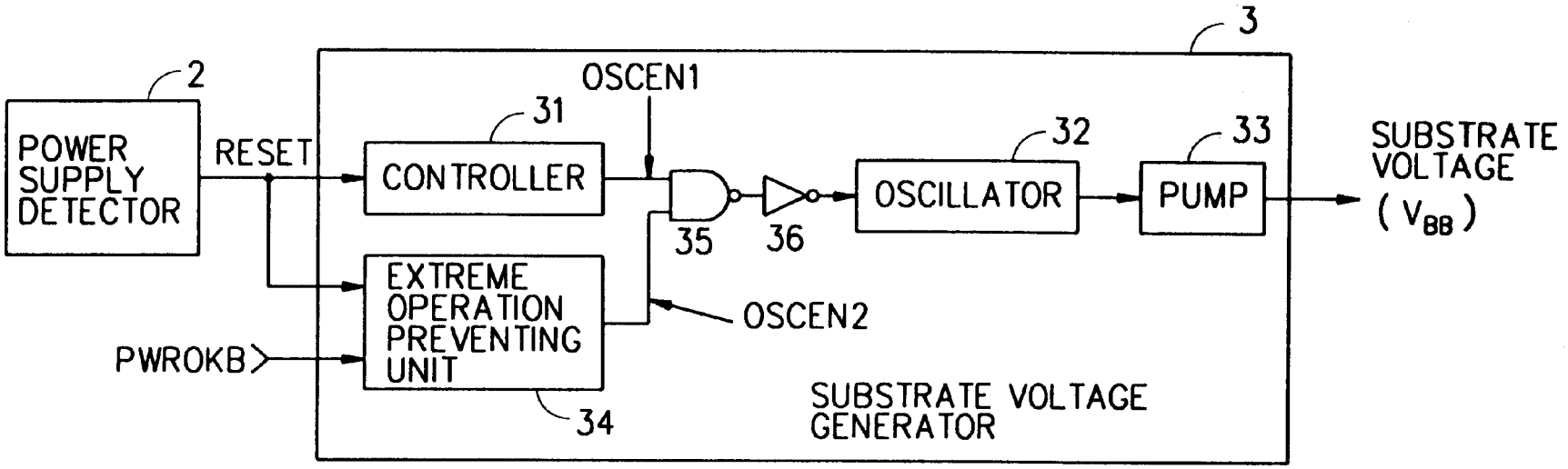
FIG. 3 is a schematic block diagram of a substrate voltage generator for a semiconductor device according to the present invention.
Figure 4:
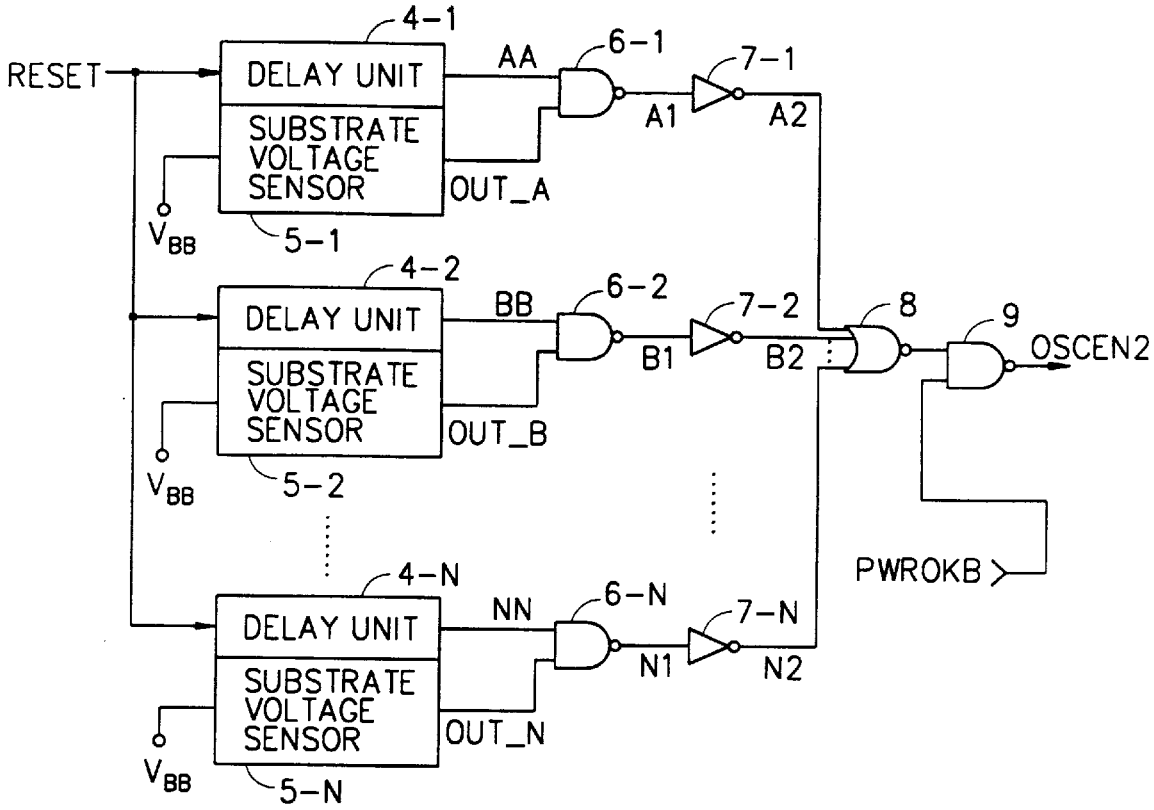
FIG. 4 is a detail block diagram of an extreme operation preventing unit in FIG. 3.
Figure 5:
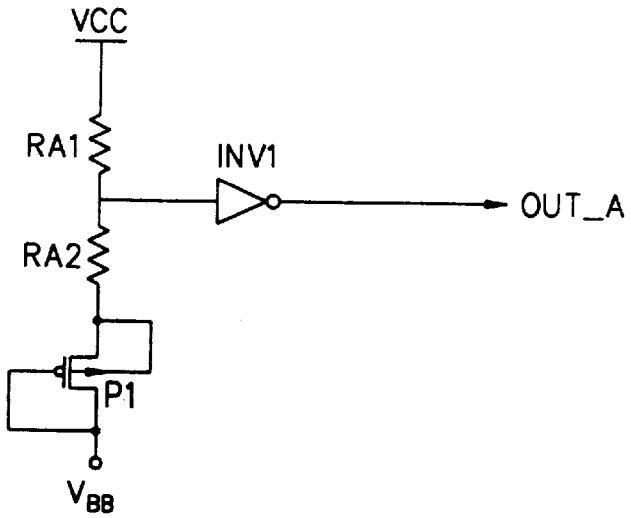
FIG. 5 is a circuit diagram illustrating a substrate voltage sensing unit in FIG. 4 according to a preferred embodiment of the present invention.

For each unit in FIG. 3 according to the present invention, FIG. 4 illustrates a construction of an extreme operation preventing unit according to a preferred embodiment of the present invention. FIG. 5 substantially illustrates a substrate voltage $V_{BB}$ sensor in FIG. 4. FIG. 6 illustrates wave diagrams of each unit shown in FIGS. 4 and 5.

FIG. 3 is a block diagram schematically illustrating the theory of the present invention. As shown therein, a substrate voltage generator 3 starts to operate when receiving a reset signal supplied from a power supply detector 2.

The substrate voltage generator 3 is composed of a controller 31, an extreme operation preventing unit 34, a NAND gate 35 for receiving outputs from the controller 31 and the extreme operation preventing unit 34, respectively, an inverter 36 connected with an output supplied from the NAND gate 35, an oscillator 32 operated in accordance with an output of the inverter 36 and a pump circuit 33 connected with the oscillator 32. Here, the extreme operation preventing unit 34 also receives the reset signal from the power supply detector 2 and a power-up end signal PWROKB which indicates that an internal state of a chip device is in a normal operation state. As an extreme operation preventing unit 34 is employed, it can be understood that the substrate voltage generator 3 according to the present invention may employ a second oscillator enable signal OSCEN 2, besides a first oscillator enable signal OSCEN1 which is supplied from the controller 31. Here, combining the two signals, the first and the second oscillator enable signals OSCEN1, OSCEN2, determines a generation result of the substrate voltage. FIG. 4 illustrates an embodiment of the extreme operation preventing unit 34 for generating the second oscillator enable signal OSCEN2. As shown therein, the extreme operation preventing unit 34 includes: a plurality of delay units 4-1,4-2 . . . 4-N each receiving a reset signal from the power supply detector 2; a plurality of substrate voltage $V_{BB}$ sensors 5-1,5-2 . . . 5-N each being coupled with the corresponding delay unit; a plurality of NAND gates 6-1,6-2 . . . 6-N each of which receives outputs from the corresponding delay unit and the substrate voltage sensor, respectively; a plurality of inverters 7-1,7-2 . . . 7-N each being connected with the corresponding NAND gate 6-1,6-2 . . . 6-N; a NOR gate 8 for receiving outputs from the inverters 7-1,7-2 . . . 7-N; and a NAND gate 9 for receiving an output from the NOR gate 8 and the power-up end signal PWROKB. Here, note that each of the delay units 4-1,4-2 . . . 4-N processes a different delay. In addition, each substrate voltage $V_{BB}$ sensor assigned to each delay unit having the different delay senses a different substrate voltage $V_{BB}$ level. Thus, the first delay unit 4-1 and the first substrate voltage sensor 5-1 shown in FIG. 4 sense a first delay and a first substrate voltage level, respectively, and the Nth delay unit 4-N and the Nth substrate voltage sensor 5-N sense an Nth delay and an Nth substrate voltage level, respectively.

FIG. 5 illustrates an implementation with respect to the substrate voltage sensors 5-1,5-2 . . . 5-N for sensing the different substrate voltage levels according to the present invention. Since each of the substrate voltage sensors 5-1, 5-2 . . . 5-N is identically constructed, only a single circuit thereof is illustrated. As shown therein, each substrate voltage sensor is composed of first and second resistances RA1,RA2, and a PMOS transistor P1 which are connected in series between the power supply voltage Vcc and the substrate voltage $V_{BB}$, and an inverter INV1 connected between the serially connected first and second resistances RA1,RA2. A gate and a drain of the PMOS transistor P1 are connected with the substrate voltage $V_{BB}$. Here, resistance values of the resistances RA1,RA2 are set at a predetermined ratio, and the ratio is differently shown by each substrate voltage sensor, for thereby detecting a different substrate voltage level.

In FIG. 3, as the external voltage Vcc becomes a predetermined level, and when the power supply detector 2 outputs the reset signal at a time $t_1$, the reset signal as shown in FIG. 6A which has been transited to a low level is applied to the controller 31 and the extreme operation preventing unit 34, respectively, of the substrate voltage generator 3.

The delay units 4-1,4-2 . . . 4-N of the extreme operation preventing unit 34 start operating by simultaneously receiving the reset signal, for whereby the first delay unit 4-1 generates a signal AA which maintains a high level from $t_1$ to $t_2$, and the first substrate voltage sensor 5-1 senses a level of the substrate voltage $V_{BB}$ at this time and provides an output OUT_A, as shown in FIG. 6C, when sensing the desired voltage level. Since the initially generated voltage is not at the desired level, the first substrate voltage sensor 5-1 outputs a signal at a high level, and the signal therefrom is inputted to the first NAND gate 6-1 with the output from the first delay unit 4-1, for thus a signal at a high level is outputted by the NAND gate 6-1 and the first inverter 7-1. Here, as long as the power -up end signal PWROKB is maintained at a high level during the process of the power-up, the second oscillator enable signal OSCEN2 is maintained at the high level. Accordingly, the controller 31, the oscillator 32 and the pump circuit 33 are sequentially operated until the desired substrate voltage value is abtained.

That is, in FIG. 5, a voltage difference between the substrate voltage $V_{BB}$ and the power supply voltage Vcc is divided in accordance with the resistance ratio between the first and second resistances RA1,RA2 of the substrate voltage sensor, for thereby supplying a low-level signal to the inverter INV1. The change of the substrate voltage $V_{BB}$ varies the voltage divided amount, for thereby changing the output of the inverter INV1, and the first substrate voltage sensor 5-1 outputs the signal OUT_A at the high level, as shown in FIG. 6C. The signal OUT_A at the high level is applied to the NAND gate 6-1 with the output from the first delay unit 4-1, and thus the NAND gate 6-1 generates a signal A1 at a low level. The signal A1 is inverted by the inverter 7-1, thereby again becoming the high level signal. At time t2, the voltage gererator, as shown in FIG. 6E, which will be applied to the NOR gate 8. Since the signal PWROKB is maintained at the high level, the NAND gate 9 which receives the output supplied from the NOR gate 8 and the signal PWROKB outputs the second oscillator enable signal OSCEN2 at the high level, as shown in FIG. 6K.

Figure 6M:
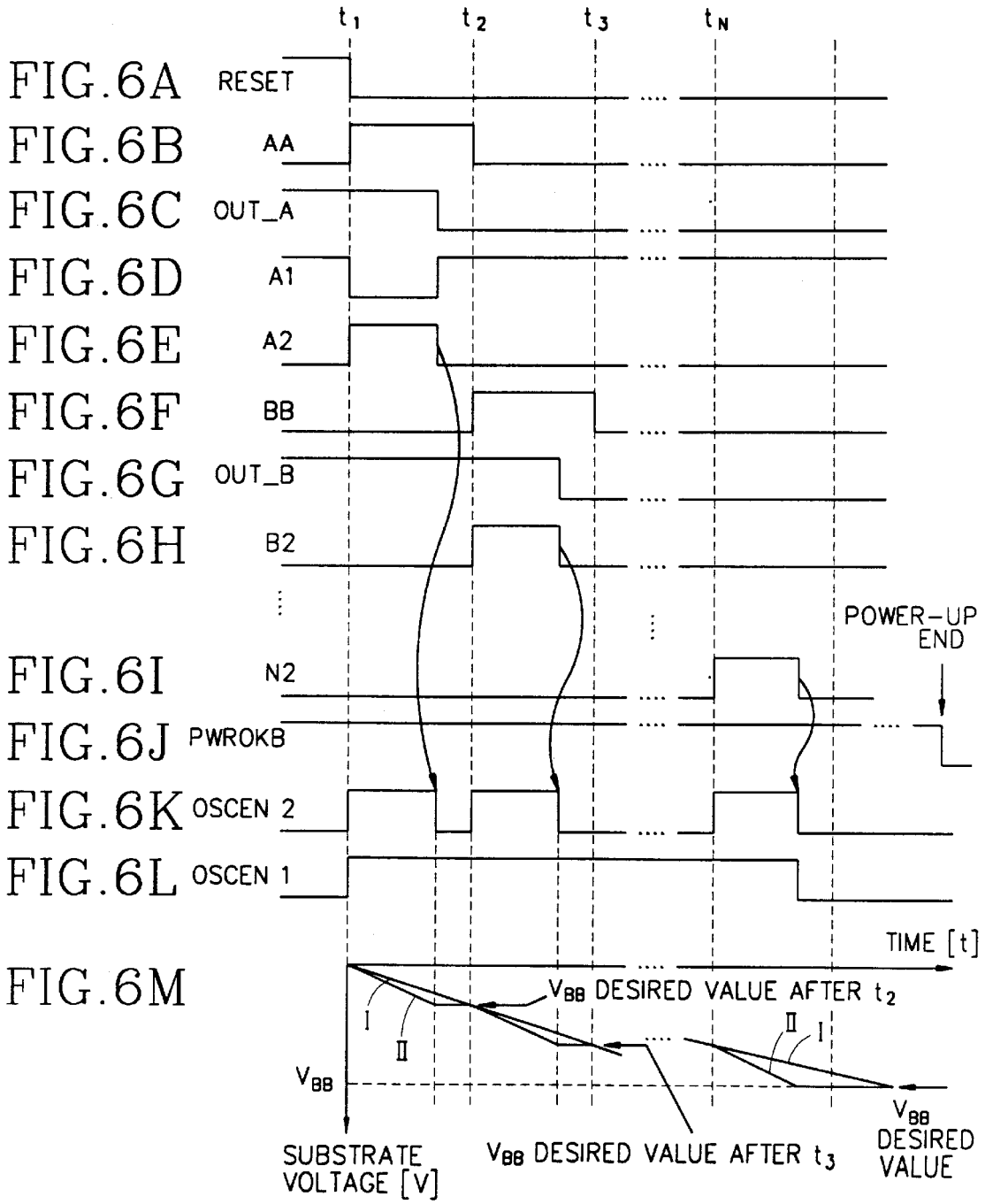

Here, since the operation with respect to the first oscillator enable signal OSCEN1 in FIG. 6L is same as the case in FIG. 1, its detailed description will be omitted. Accordingly, as long as the output from the first substrate voltage sensor 5-1 maintains the high level, the substrate voltage OUT_A is developed towards the desired value, as shown in FIG. 6M which shows two graphs, wherein the graph 'I' indicates the desired substrate voltage level development during the course of time according to the implementation of the invention, whereas the graph 'II' indicates the desired substrate voltage level development in the event of extreme operation.

As shown in the graph 'I' of FIG. 6M, when the substrate voltage reaches the desired value, the signal AA outputted from the first delay unit 4-1 is changed to a low level at the time t2, and the second delay unit 4-2 starts operating the sequences as mentioned before, as shown in FIG. 6F.

In FIG. 6M, the second delay unit 4-2 and the second substrate voltage sensor 5-2 are operated in accordance with the desired substrate voltage value after a time is t3, and also the third, fourth . . . and Nth delay units and substrate voltage sensors are also repeatedly operated in the same manner as the second delay unit 4-2 and the second substrate voltage sensor 5-2, until the substrate voltage reaches the desired value and thus the power-up is completed.

On the other hand, as shown in the graph 'II' of FIG. 6M, at the point which the substrate voltage level reaches the desired value earlier than the designed arrival time because the substrate voltage is extremely pumped, the level of the output OUT_A of the substrate voltage detector 5-1 in FIG. 5 is transited to the low level and accordingly, the second oscillator enable signal OSCEN2 becomes the low level, so that the operation of the substrate voltage generator is suspended. The above state is maintained up to the time t2 without any change, and thus the substrate voltage pumping is suspended, and does not further develop. At time t2, the voltage generator becomes activated when the first delay unit 4-1 outputs the signal AA at the low level, meaning that the extreme pumping has been suspended at the first desired value and the substrate voltage development proceeds towards the second desired value. Specifically, since the pumping operation is continued during the time which the second oscillator enable signal OSCEN2, generated by the substrate voltage level sensing operation, maintains the high level, the substrate voltage $V_{BB}$ does not drop to an extremely low level and maintains a steady level until the next time period. Of course, when the substrate voltage level does not drop lower than the desired value, the second oscillator enable signal OSCEN2 continually maintains the high level during the power-up period, while the signal PWORKB is maintained at the high level, for thus driving the substrate voltage generator.

Figure 7:
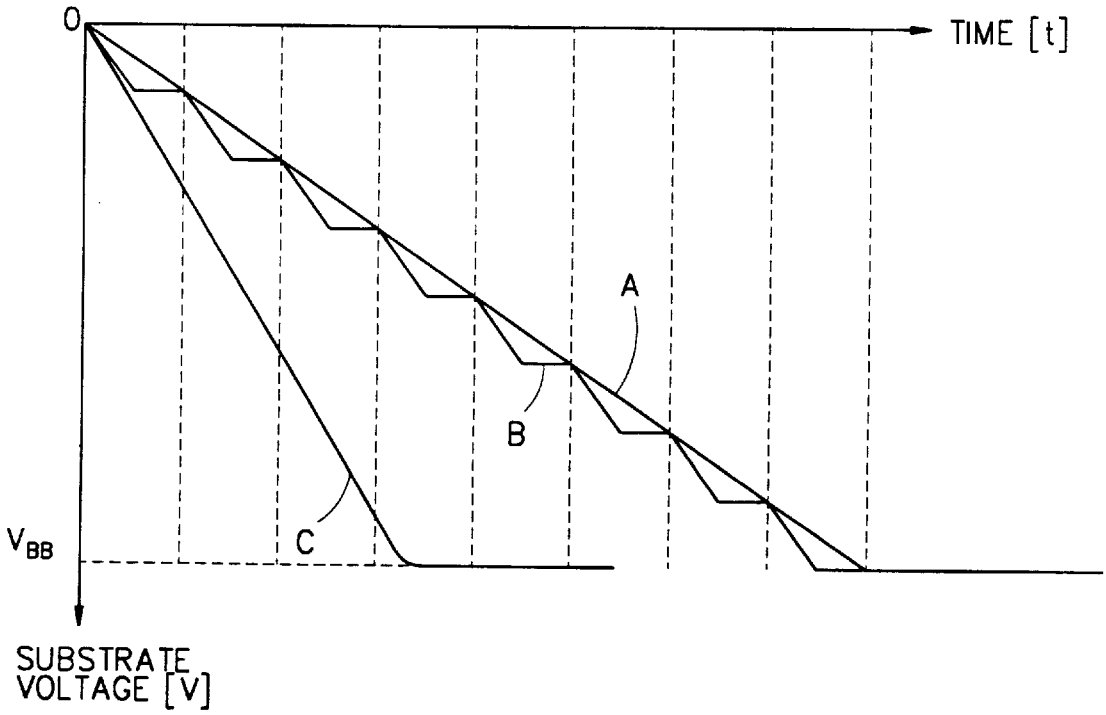
FIG. 7 is a graph comparing substrate voltage generation development according to the present invention with the same according to the conventional art.

FIG. 7 shows the comparison of the substrate voltage generation according to the present invention with the same according to the conventional art.

In FIG. 7, the graphs A and B respectively indicate the desired substrate voltage level development and the substrate voltage level development according to the present invention, and the graph C shows the same according to the conventional art, particularly in the case where the substrate voltage is extremely pumped.

As described above, when the substrate voltage is changed to an extreme level due to any reason, the substrate voltage generator according to the present invention controls the further generation of substrate voltage to thus prevent erroneous operations of other internal voltage generation circuits, particularly of the reference voltage generator. According to the present invention, the time to the power-up end point is divided into a plurality of time periods and the desired substrate voltage value which has been set is sensed during each period.

It will be apparent to those skilled in the art that various modifications and variations can be made in the substrate voltage generator for the semiconductor device of the present invention without departing from the spirit or scope of the invention. Thus, it is intended that the present invention cover the modifications and variations of this invention provided they come within the scope of the appended claims and their equivalents.

What is claimed is:

1. A substrate voltage generator, comprising:

a control unit for controlling an operation of the substrate voltage generator upon receiving a power supply voltage;

an oscillator operated by the control unit;

a pump circuit for performing a pumping operation in accordance with the oscillator, for thereby generating a substrate voltage; and an extreme operation preventing unit for preventing the substrate voltage from being generated at an extreme level by further controlling, over a course of a plurality of time periods, the operation of the oscillator in accordance with the generated substrate voltage, such that oscillation is suspended in a time period in said plurality of time periods when the substrate voltage reaches a predetermined desired value associated with that time period.

2. The generator of claim 1, wherein the extreme operation preventing unit comprises:

a plurality of delay means, each delay means responding during power-up, and having a different delay volume and providing an output for a respective predetermined period;

a plurality of substrate voltage sensing means, each sensing means being coupled with a corresponding delay means, respectively, and sensing the substrate voltage during the respective predetermined period; and means for generating a control signal to control the operation of the oscillator on the basis of the output supplied from each of the delay means and an output from each of the substrate voltage sensing means.

3. The generator of claim 2, wherein each of the substrate voltage sensing means comprises a plurality of resistance elements connected in series between a power source potential and the sensed substrate voltage, and a logic element for responding to an output from the resistance elements and the logic element generating a signal at a predetermined logic level.

4. The generator of claim 1, further comprising:

a power supply detecting means for detecting power-up, and outputting a signal to the control unit and to the extreme operation preventing unit.

5. The generator of claim 1, wherein the oscillator is operated by outputs supplied from the control unit and the extreme operation preventing unit.

6. The generator of claim 2, wherein the extreme operation preventing unit responds to a power-up end signal, for thereby generating the control signal.

7. A substrate voltage generator, comprising:

a power supply detecting means for detecting power-up and outputting a detection signal;

a control unit for receiving said detection signal and outputting a first control signal to control an operation of the substrate voltage generator;

an oscillator operated by the control unit;

a pump circuit for performing a pumping operation in accordance with the oscillator, for thereby generating a substrate voltage; and an extreme operation preventing unit for preventing the substrate voltage from being generated at an extreme level by outputting a second control signal to further control, over a course of a plurality of time periods, the operation of the oscillator in accordance with the generated substrate voltage such that oscillation is suspended in a time period in said plurality of time periods when the substrate voltage reaches a predetermined desired value associated with that time period.

8. The generator of claim 7, wherein the extreme operation preventing unit comprises:

a plurality of delay means, each delay means responding during power-up, and having a different delay volume and providing an output for a respective predetermined period;

a plurality of substrate voltage sensing means, each sensing means being coupled with a corresponding delay means, respectively, and sensing the substrate voltage during the respective predetermined period; and means for generating the second control signal to control the operation of the oscillator on the basis of the output supplied from each of the delay means and an output from each of the substrate voltage sensing means.

9. The generator of claim 8, wherein each of the substrate voltage sensing means comprises a plurality of resistance elements connected in series between a power source potential and the sensed substrate voltage, and a logic element for corresponding to an output from the resistance elements and the logic element generating a signal at a predetermined logic level.

10. An apparatus, comprising:

a generator to generate a substrate voltage, said generator including a second controller to controllably provide a second enable signal upon receiving a power supply voltage to control growth of a magnitude of said substrate voltage discontinuously as a function of a sensed voltage; said generator also including an oscillator to generate a third enable signal in accordance with a first enable signal and said second enable signal; and said generator further including a pump circuit to output said substrate voltage in accordance with said third enable signal; and a first controller providing said first enable signal to cause said generator to grow said magnitude of said substrate voltage discontinuously depending on a rate of growth of said substrate voltage.

* * * * *